US005813186A

United States Patent [19]

Acksel

[11] Patent Number: 5,813,186

[45] Date of Patent: Sep. 29, 1998

[54] CONSTRUCTION BLOCKS WITH COMPLEMENTARY INTERSTITIAL MODULES

[76] Inventor: Ione Acksel, 1267 Carlls Straight Path, Dix Hills, N.Y. 11746

[21] Appl. No.: 804,944

[22] Filed: Feb. 24, 1997

[51] Int. Cl.[6] ..... G04B 5/04

[52] U.S. Cl. ..... 52/604; 52/605; 52/608; 52/306

[58] Field of Search ..... 52/306–308, 603–605, 52/608, 311.1, 311.2; 404/41, 42

[56] References Cited

U.S. PATENT DOCUMENTS

| | | | |
|---|---|---|---|
| 2,086,185 | 7/1937 | Keaney | 52/306 |
| 2,110,885 | 3/1938 | Lytle | 52/306 |
| 3,931,700 | 1/1976 | Scanni et al. | 52/311.2 |
| 3,947,192 | 3/1976 | Rosenberger | 52/604 X |
| 4,651,486 | 3/1987 | Erickson | 52/306 |
| 4,719,735 | 1/1988 | Fleming et al. | 52/306 |
| 4,852,321 | 8/1989 | Fleming et al. | 52/306 |
| 4,919,565 | 4/1990 | Gopfert | 404/41 |
| 5,067,295 | 11/1991 | Francik et al. | 52/306 |
| 5,109,644 | 5/1992 | Poremba | 52/306 |
| 5,201,602 | 4/1993 | Repasky | 52/608 X |
| 5,277,514 | 1/1994 | Glickman | 404/41 |
| 5,333,427 | 8/1994 | Uhlik | 52/306 |
| 5,466,089 | 11/1995 | Jurik | 52/603 X |
| 5,634,313 | 6/1997 | Mogling | 52/604 X |

FOREIGN PATENT DOCUMENTS

| | | | |
|---|---|---|---|
| 470835 | 11/1935 | United Kingdom | 52/306 |

OTHER PUBLICATIONS

PC Glass Blcok, "For New Homes & Remodeling", 1988.

*Primary Examiner*—Beth A. Aubrey
*Attorney, Agent, or Firm*—Kenneth P. Robinson

[57] ABSTRACT

A set of complementary block units suitable for wall construction includes a first block unit of cylindrical contour (e.g., circular, elliptical, hexagonal) and a plurality of interstitial block units for interfacing and supporting the circular or elliptical block units when arranged in a suitable pattern. Each block unit may include a peripheral groove or ridge suitable for receiving grouting. The blocks are formed with surfaces having complementary shaped edges, such that any one of a plurality of interstitial block units will interface with any cylindrical block unit of a set. Three configurations of interstitial units enable combination with cylindrical units in edge, corner and internal positions within a wall or window structure.

23 Claims, 4 Drawing Sheets

CONSTRUCTION BLOCKS WITH COMPLEMENTARY INTERSTITIAL MODULES

RELATED APPLICATIONS (Not Applicable)

FEDERALLY SPONSORED RESEARCH (Not Applicable)

BACKGROUND OF THE INVENTION

The invention relates to building blocks, and, more particularly, to a set of block units of modular complementary form, such that cylindrical glass blocks when assembled in juxtaposed relationship with complementary interstitial block units form a window or other light transmissive panel suitable for use in connection with wall, door, counter and other construction.

Decorative panels of glass or masonry block have been used in the construction of building walls, in particular, when light transmissive properties are desired. Blocks suitable for this application have generally been restricted to a plurality of preformed modules of regular square or rectangular shape, such that similarly shaped blocks are arranged in courses one on top of the other, with interlocking lands and grooves or cementations materials used to bond the courses into a construction panel. However, such blocks permit relatively limited flexibility in arrangement and notably have not been adaptable to construction with non-rectangular block modules because of the lack of stability when arranged in courses.

Advantageously, the present invention provides a cylindrical block unit with a plurality of conforming interstitial block units of differing configurations, which may be juxtaposed in complementary relationship to form a structurally sound building panel. Further, when partially or completely made of a glass material, the panel may offer a controllable degree of light transmissive properties.

SUMMARY OF THE INVENTION

According to the present invention there is provided a set of complementary block units suitable for panel construction. A cylindrical block unit adapted to interact with an interstitial block unit is formed, preferably of glass material, with front and rear surfaces respectively having front and rear convex curved peripheral edges spaced apart by a cylindrical side surface, and having either a groove or ridge extending at least partially around the side surface, which is adapted to receive grout material.

There is further provided an interstitial block unit with front and rear surfaces having peripheral edges each including at least one concave curved edge portion dimensioned for complementary fit with a portion of the convex curved peripheral edges of the cylindrical block unit. The interstitial block unit includes between the concave curved edge portions an arcuate side surface having either a ridge or a groove positionable adjacent to the side surface of the cylindrical block unit so as to be suitable for receiving grout material. As will be described, in a particular block set the interstitial block may have one of three different configurations.

In the embodiment set forth above, the interstitial block unit is formed of glass or other material. Further, each of the cylindrical and interstitial block units may preferably be formed of glass material having at least one of the following properties: clear, translucent, opaque, colorless, colored, frosted, or textured.

In a preferred embodiment of the set of complementary block units the front and rear convex curved edges of the cylindrical block unit are circular and the concave curved edge portions of the interstitial block unit each comprise a portion of a circle. In a further embodiment of the set of complementary block units as set forth above the front and rear convex curved edges of the cylindrical block unit are elliptical and the concave curved edge portions of the interstitial block unit each comprise a portion of an ellipse. In another embodiment, cylindrical block units of hexagonal form are combined with interstitial block units having a diamond shape.

For the block set referred to above, the first configuration of an interstitial block unit has front and rear surfaces which each include two substantially linear edge portions which meet perpendicularly to form a corner. In a second configuration the front and rear surfaces of the interstitial block unit each include two concave curved edge portions dimensioned for complementary fit with a portion of the edge of each of two laterally spaced cylindrical block units. In this configuration the front and rear surfaces of the interstitial block unit each also include a substantially linear edge portion. In a third configuration, the front and rear surfaces of an interstitial block unit each include four concave curved edge portions dimensioned for complementary fit with a portion of the edge of each of four cylindrical block units when arranged peripherally in juxtaposition with the aforesaid interstitial block unit.

For a better understanding of the invention, together with other and further objects, reference is made to the accompanying drawings and the scope of the invention will be pointed out in the accompanying claims.

DESCRIPTION OF THE PREFERRED EMBODIMENTS

Figure 1A:
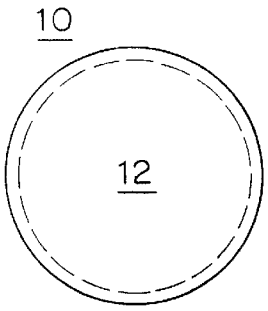
FIG. 1A illustrates the front face of a circular block unit according to an embodiment of the present invention.
Figure 1B:
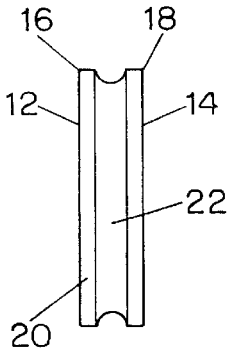
FIG. 1B is a side view of the circular block unit of FIG. 1A.

Referring now to the drawings, in which a single reference number refers to the same or similar elements, the embodiment illustrated in FIGS. 1A and 1B show a structural module 10 suitable for use in panel construction. Module 10 is shown in the form of a circular cylindrical block unit 10 formed of glass material. The term "glass material" is defined to include glass and other materials which may have light transmissive qualities and provide a structural stability suitable for use in wall construction. FIG. 1A is a front face view while FIG. 1B is a corresponding side view. Cylindrical block unit 10 is provided with a planar front surface 12 and rear surface 14. Reference numbers 16 and 18 designate front and rear convex curved peripheral edges, respectively, spaced apart by a cylindrical side surface 20 and provided with a groove 22 extending at least partially around side surface 20. Groove 22 is intended to be sized to be suitable for receiving grout for bonding the various complementary block units into a rigid structure. For present purposes, "grout" is defined as including all suitable bonding materials, including cementatious material, as well as epoxy, glue and other adhesive materials.

Figure 2A:
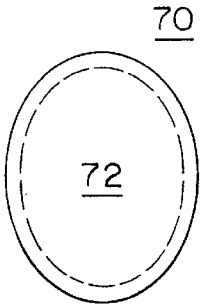
FIG. 2A illustrates the front face of an elliptical block unit according to a different embodiment of the present invention.
Figure 2B:
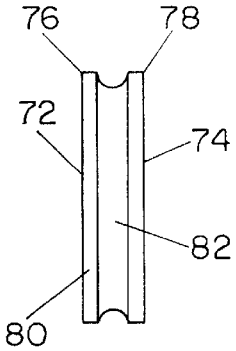
FIG. 2B is a side view of the elliptical block unit of FIG. 2A.

FIGS. 2A and 2B depict another embodiment wherein an elliptical block unit 70 forms the primary structural module. Reference numeral 72 shows the front surface and reference numeral 74 the rear surface. In a manner corresponding to the cylindrical block unit 10, elliptical block unit 70 is configured with front and rear convex elliptically curved peripheral edges 76, 78 and spaced apart by a cylindrical side surface 80 having a circumferential groove 82 for receiving grout material.

Figure 3A:
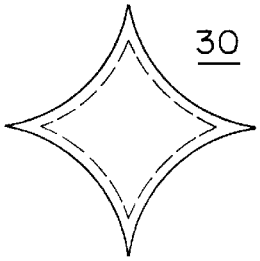
FIG. 3A is a front face view of an interstitial block unit embodying the present invention.
Figure 3B:
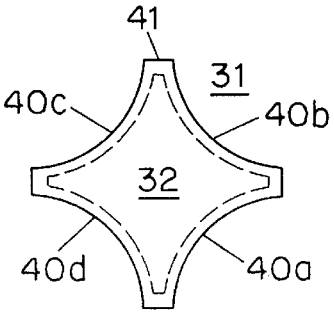
FIG. 3B is a front face view of a modification of the interstitial block unit of FIG. 3A.
Figure 3C:
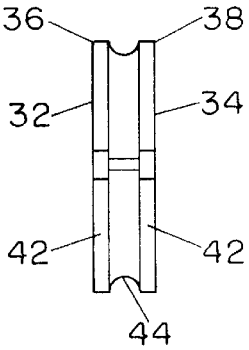
FIG. 3C is a side view of the interstitial block unit of FIG. 3B.
Figure 4A:
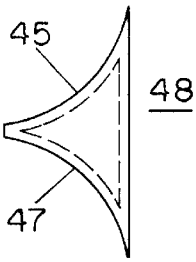
FIG. 4A is a view of the front face of a different embodiment of an interstitial block unit.
Figure 4B:
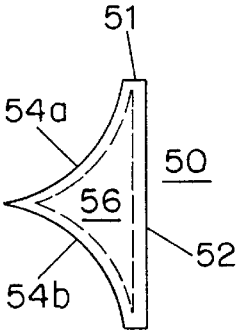
FIG. 4B is a front face view of a modified embodiment of FIG. 4A.
Figure 4C:
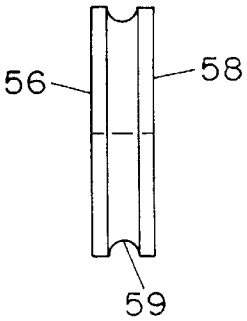
FIG. 4C is a side view of the interstitial block unit of FIG. 4B.

FIGS. 3, 4, and 5 are illustrative of various configurations of an interstitial block unit which is used in juxtaposition with aforesaid structural modules 10 or 70 in constructing a wall panel. By an interstitial block unit we refer to a complementary module which conforms to the peripheral shape of the structural module and is placed between pairs of laterally displaced structural modules or at the boundaries of a desired block panel assembly to provide a regular conformation for ease of utilization in windows, walls and other units of panel construction. The interstitial block units 30, 31, 48, 50, 60 and 62 are provided with front and rear surfaces having peripheral edges each including at least one concave curved edge portion dimensioned for complementary fit with a portion of the convex curved peripheral edges of the circular or elliptical block units 10, 70. While illustrated with circular edge portions, the interstitial block units would be formed with complementary elliptical edge portions for use with elliptical block unit 70. The interstitial block units are also furnished with a groove for receiving grout material when placed in juxtaposition with a structural block unit. Thus, as shown in front face view 3B and side view 3C, interstitial block unit 31 has a front surface 32 and a rear surface 34, front and rear peripheral edges 36 and 38 each including at least one concave curved edge portion 40*a*–40*d*, arcuate side surfaces 42, and a groove 44 positioned adjacent to groove 22 of cylindrical block unit 10 or groove 82 of elliptical block unit 70.

Preferably, at least the cylindrical block units set forth above are formed of glass material which may have at least one of the following transmissive properties: clear, translucent, opaque, colorless, colored, frosted and textured. Such properties may be imparted to glass materials by conventional glass fabricating methods which are well known. The interstitial block units may be formed of similar or different glass material, or of a different type of material, such a brick, ceramic, simulated stone, etc. Thus, in different applications, the entire block structure (except for grouting) may be light transmissive or only the cylindrical units may have such quality.

In a first preferred embodiment, the front and rear convex curved edges 16, 18 of cylindrical block unit 10 are circular and the corresponding concave curved edge portions of an interstitial block each comprise a portion of a circle, typically as shown by FIG. 3A, 40*a*. Where the embodiment is an elliptical block unit 70, the front and rear convex curved edges of the interstitial block each comprise a portion of an ellipse.

Referring now to FIG. 4B, for example, the front surface 56 includes a substantially linear portion 52 and rear surface 58 includes a corresponding linear portion. FIGS. 5B and 5C show front and side views of an interstitial block unit 61 having two substantially linear edge portions 62, 64 which meet perpendicularly. FIGS. 4A and 4B show complementary block units wherein the front and rear surfaces 56, 58 each include at least two concave curved edge portions 45, 47 and 54*a*, 54*b* dimensioned for complementary fit with a portion of the edge of each of two laterally spaced structural block units 10.

Figure 5A:
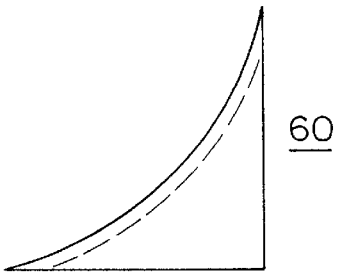
FIG. 5A is a front face view of a further embodiment of an interstitial block unit.
Figure 5B:
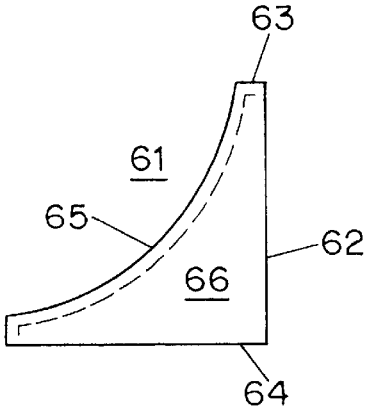
FIG. 5B is a modification of the interstitial block unit of FIG. 5A.
Figure 5C:
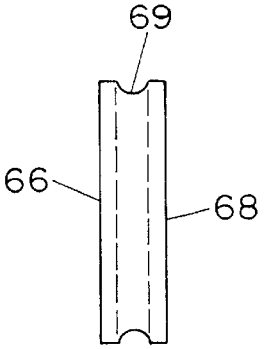
FIG. 5C is a side view of the interstitial block unit shown in FIG. 5B.

With reference to FIGS. 4A and 5A, the front and rear surfaces of an interstitial block unit may include at least one substantially linear edge portion which meets one of the respective concave curved portions (i.e., 45, 47) substantially tangentially. Alternatively, as shown in FIGS. 4B and 5B, a concave curved portion, such as 54*a* or 65, may be separated from an adjacent linear portion, such as 52 or 62, by a small edge portion, such as 51 or 63, respectively.

In a preferred embodiment, interstitial block unit 31 may include four concave curved edge portions 40*a*, 40*b*, 40*c*, 40*d* dimensioned for complementary fit with a portion of the edge of each of four cylindrical block units when arranged peripherally in juxtaposition therewith. This is shown most clearly in FIG. 6, where cylindrical block units 81, 82, 83 and 85 are disposed adjacent to interstitial block 88, which corresponds to interstitial block unit 30 as previously described.

Figure 6:
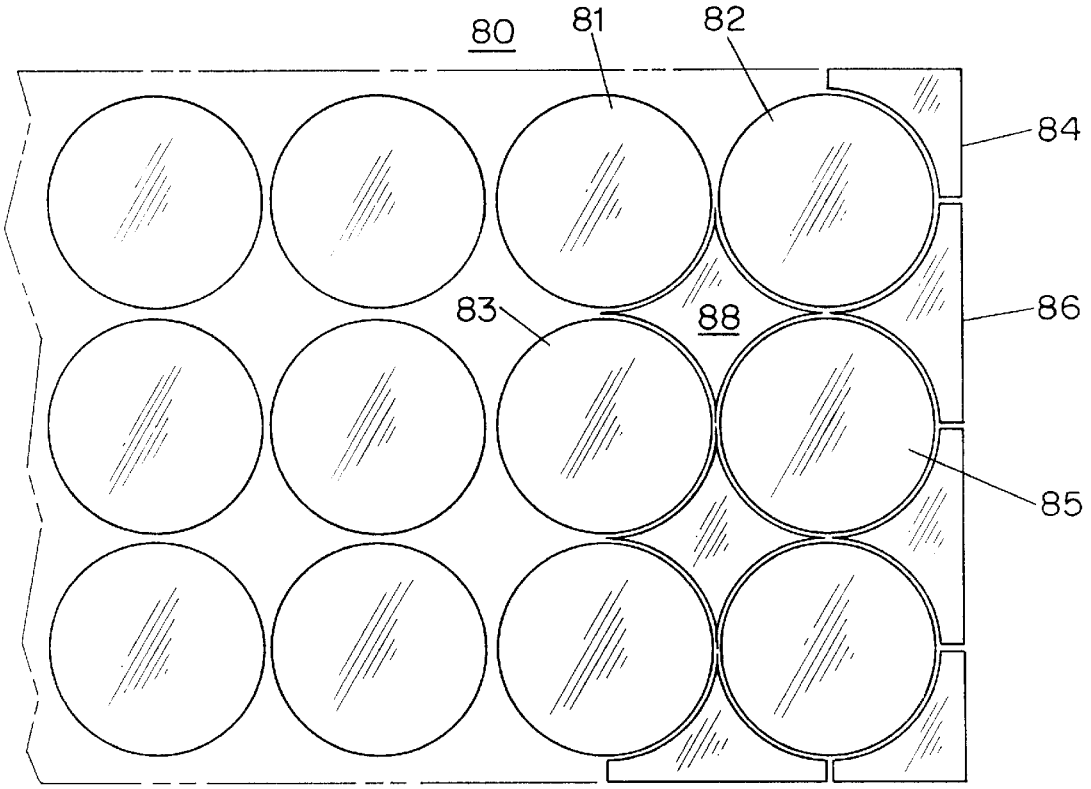
FIG. 6 is a conceptual drawing illustrating the application of complementary interstitial block units juxtaposed with circular block units to form a window or building panel suitable for use in wall construction.

As shown in FIG. 6, a representative set of complementary block units 80 comprises a cylindrical block unit 81 having a circular contour or an elliptical block unit (not shown), a first interstitial block unit 84 having front and rear surfaces each having two substantially linear edge portions which meet perpendicularly, a second interstitial block unit 86 comprising front and rear surfaces having at least two concave curved edge portions dimensioned for complementary fit with a portion of the edge of each of two laterally spaced cylindrical (or elliptical) blocks 82 and 85, and a third interstitial block unit 88 comprising front and rear surfaces each including four concave curved edge portions dimensioned for complementary fit with a portion of the edge of each of four cylindrical (or elliptical) block units 81, 82, 83, 85, the cylindrical block units being arranged peripherally in juxtaposition with interstitial block unit 88.

It will be seen that the first, second and third interstitial block units 84, 86,88 are sized accordingly to receive and support at least one of a plurality of the circular or elliptical block units 81, 82, 83, 85. When the complementary components are grouted and cured, there results a novel, stable and visually distinctive panel suitable for panel construction, with great flexibility in utility in the field. The term "panel construction" is defined to include the use of block units for construction of window portions of walls, complete walls or sections thereof, sections of cabinets, counter-top supports, and other items.

As will be discussed further with reference to FIGS. 7A, 7B, 9A, 9B, 9C and 9D, a variety of side surface configurations can be employed pursuant to the invention. Thus, FIGS. 2B and 3C show cylindrical and interstitial block units each having a transverse groove suitable for -receiving a significant quantity of grout of a relatively thick cementatious type. FIGS. 7A, 7B, 9A, 9B, 9C and 9D show complementary side surface configurations which fit more closely together so as to be particularly effective for use with a thinner grout such as a suitable epoxy, glue or other adhesive material. With reference to FIG. 9D, for example, it will be appreciated that the cylindrical block units of a set may have either a convex ridge as shown above or a concave groove as shown below in FIG. 9D. The side surfaces of the interstitial block units of the set would preferably have the opposite concave/convex characteristic, e.g., a complementary concave groove or a complementary convex ridge, respectively.

Figure 7A:
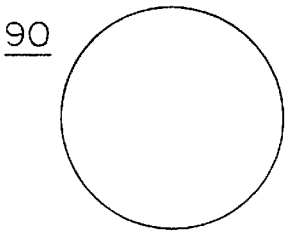
FIG. 7A is a front face view of an alternative embodiment of the FIG. 1 circular block unit.
Figure 7B:
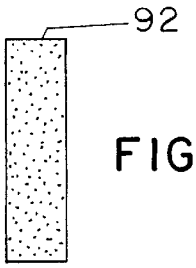
FIG. 7B is a side view of the circular block unit of FIG. 7A.

Referring now more particularly to FIGS. 7A and 7B, there is illustrated an alternative embodiment of the invention wherein the side surfaces of cylindrical and interstitial block units are provided in a form suitable for receiving grout material without the need for a distinct groove per se. Accordingly, cylindrical block unit 90 of FIGS. 7A and 7B is similar to unit 10 of FIG. 1A, except that a distinct groove is not present in the side surface 92. Instead, side surface 92 is formed to include small grooves, surface roughness or other surface configuration or preparation suitable for receiving grout material in order to permit assembly into a stable wall structure. For use with the cylindrical block unit of FIGS. 7A and 7B, interstitial block units such as described above would typically have the same type of, or a compatible type of, side surface configuration or preparation as the cylindrical block units of that set.

Figure 8:
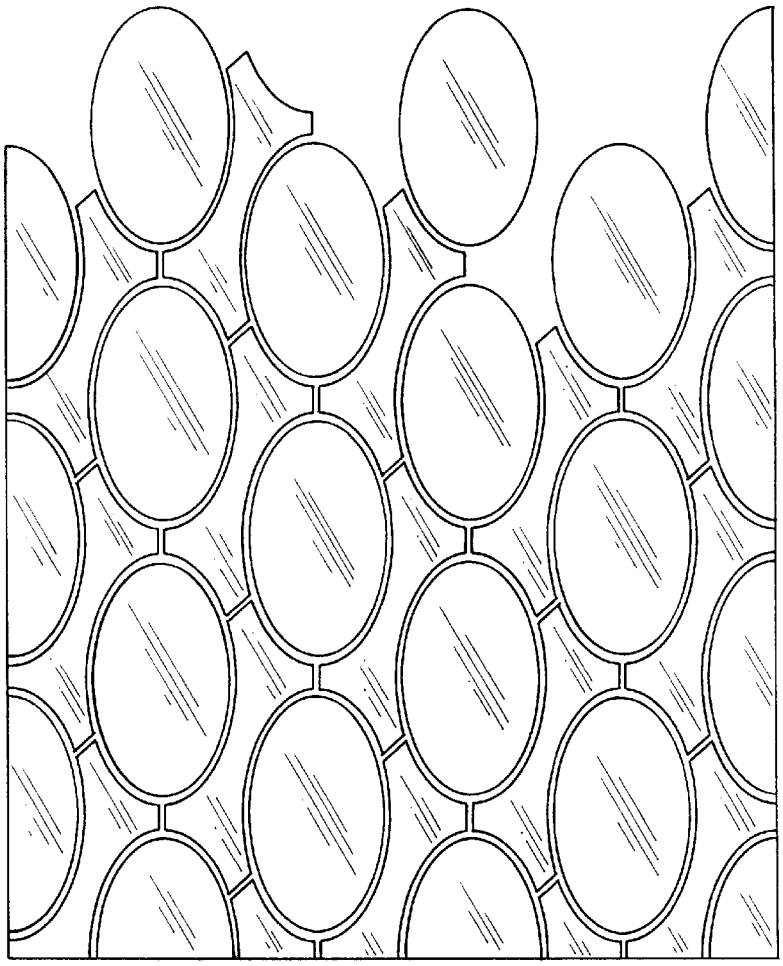
FIG. 8 is a conceptual drawing illustrating an embodiment of the invention utilizing elliptical block units with a different form of complementary interstitial block units.
Figure 9A:
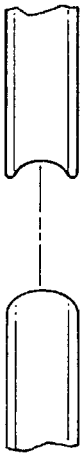
FIGS. 9A, 9B, 9C and 9D are partial side views showing different forms of complementary ridge and groove edge profiles usable for block units in accordance with the invention.
Figure 9B:
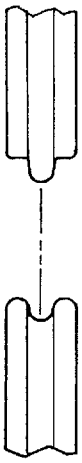
Figure 9C:
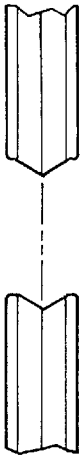
Figure 9D:
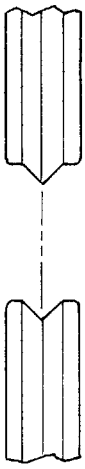
Figure 10:
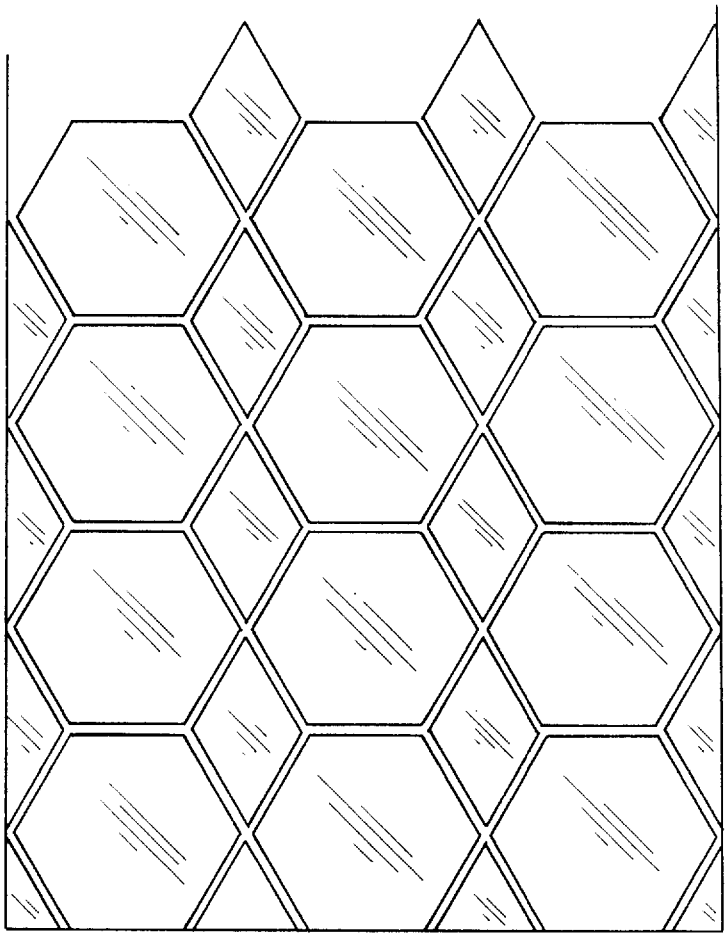
FIG. 10 is a conceptual drawing illustrating an embodiment of the invention utilizing hexagonal block units with diamond-shaped interstitial block units.

FIG. 8 shows an alternative embodiment including elliptical blocks and a different form of interstitial block units. The interstitial block units of FIG. 8 may be provided as shown, or may each be provided as two identical smaller blocks each resembling one-half of the illustrated interstitial block. FIGS. 9A, 9B, 9C and 9D show a variety of edge configurations usable for block units in accordance with the invention. As illustrated, complementary mating edge shapes can be assembled with a relatively thin grout. Thus, for example circular blocks having a concave or convex edge profile can be combined with interstitial blocks having a complementary edge profile, as illustrated in one of FIGS. 9A, 9B, 9C or 9D, or as otherwise provided by a skilled person with knowledge of the invention. FIG. 10 illustrates a further embodiment utilizing cylindrical block units of hexagonal shape in combination with interstitial block units of diamond shape. As shown, triangular interstitial block units are used at edge locations in providing a rectangular window, wall section or other panel construction. Other complementary block shape combinations can be provided by skilled persons in application of the invention. Also, while block units are illustrated as being relatively thin in relation to front face dimensions, it may typically be appropriate to provide thicker block units for added structural stability, particularly in exterior wall or window construction.

While the invention has been described in its preferred embodiments, it is to be understood that the words which have been used are words of description rather than limitation, and that changes may be made within the purview of the appended claims without departing from the true scope of the invention in its broadest aspects.

What is claimed is:

1. A set of complementary block units, suitable for use in panel construction, comprising:

a cylindrical block unit formed of glass material with front and rear surfaces respectively having front and rear convex curved peripheral edges spaced apart by a cylindrical side surface and having one of a groove and a ridge extending at least partially around said side surface, said side surface suitable for receiving grout material; and an interstitial block unit with front and rear surfaces having peripheral edges each including at least one concave curved edge portion dimensioned for complementary fit with a portion of said convex curved peripheral edges of said cylindrical block unit;

said interstitial block unit including, between said concave curved edge portions, an arcuate side surface having one of a ridge and a groove dimensioned for complementary fit with the side surface of said cylindrical block unit and suitable for receiving grout material.

2. The set of complementary block units as set forth in claim 1, wherein said interstitial block unit is formed of glass material.

3. The set of complementary block units as set forth in claim 1, wherein each of said cylindrical and interstitial block units is formed of glass material having at least one of the following properties: clear, translucent, opaque, colorless, colored, frosted, textured.

4. The set of complementary block units as set forth in claim 1, wherein said front and rear convex curved peripheral edges of said cylindrical block unit are circular and each of said concave curved edge portions of said interstitial block unit comprises a portion of a circle.

5. The set of complementary block units as set forth in claim 1, wherein said front and rear convex curved peripheral edges of said cylindrical block unit are elliptical and each of said concave curved edge portions of said interstitial block unit comprises a portion of an ellipse.

6. The set of complementary block units as set forth in claim 1, wherein said front and rear surfaces of said interstitial block unit each include a substantially linear edge portion.

7. The set of complementary block units as set forth in claim 1, wherein said front and rear surfaces of said interstitial block unit each include two substantially linear edge portions which meet perpendicularly.

8. The set of complementary block units as set forth in claim 1, wherein said front and rear surfaces of said interstitial block unit each include at least two concave curved edge portions dimensioned for complementary fit with a portion of the edge of each of two laterally spaced cylindrical block units.

9. The set of complementary block units as set forth in claim 8, wherein said front and rear surfaces of said interstitial block unit each additionally include a substantially linear edge portion.

10. The set of complementary block units as set forth in claim 1, wherein said front and rear surfaces of said interstitial block unit each include at least one substantially linear edge portion which meets one of said concave curved portions substantially tangentially.

11. The set of complementary block units as set forth in claim 1, wherein said front and rear surfaces of said interstitial block unit each include four concave curved edge portions dimensioned for complementary fit with a portion of the edge of each of four cylindrical block units when arranged in a pattern around said interstitial block unit.

12. A set of complementary block units, suitable for use in panel construction, comprising:

a cylindrical block unit formed of glass material with front and rear surfaces respectively having front and rear convex curved peripheral edges spaced apart by a cylindrical side surface, said side surface suitable for receiving grout material; and an interstitial block unit with front and rear surfaces having peripheral edges each including at least one concave curved edge portion dimensioned for complementary fit with a portion of said convex curved peripheral edges of said cylindrical block unit;

said interstitial block unit including, between said concave curved edge portions, an arcuate side surface positionable adjacent to the side surface of said cylindrical block unit and suitable for receiving grout material.

13. The set of complementary block units as set forth in claim 12, wherein said front and rear convex curved peripheral edges of said cylindrical block unit are circular and each of said concave curved edge portions of said interstitial block unit comprises a portion of a circle.

14. The set of complementary block units as set forth in claim 12, wherein said front and rear convex curved peripheral edges of said cylindrical block unit are elliptical and each of said concave curved edge portions of said interstitial block unit comprises a portion of an ellipse.

15. The set of complementary block units as set forth in claim 12, wherein said front and rear surfaces of said interstitial block unit: each include at least two concave curved edge portions dimensioned for complementary fit with a portion of the edge of each of two laterally spaced cylindrical block units; and each include a substantially linear edge portion.

16. The set of complementary block units as set forth in claim 12, wherein said front and rear surfaces of said interstitial block unit each include four concave curved edge portions dimensioned for complementary fit with a portion of the edge of each of four cylindrical block units when arranged in a pattern around said interstitial block unit.

17. The set of complementary block units as set forth in claim 12, comprising first, second and third interstitial block units of three different configurations, wherein each of said interstitial block units is sized to receive and support at least one of a plurality of said cylindrical block units in a composite wall construction.

18. The set of complementary block units as set forth in claim 17, wherein said first interstitial block unit comprises front and rear surfaces each having two substantially linear edge portions which meet perpendicularly, said second interstitial block unit comprises front and rear surfaces each having at least two concave curved edge portions dimensioned for complementary fit with a portion of the edge of each of two laterally spaced ones of said cylindrical block units, and said third interstitial block unit comprises front and rear surfaces each including four concave curved edge portions dimensioned for complementary fit with a portion of the edge of each of four cylindrical block units when arranged peripherally in juxtaposition with said third interstitial block unit.

19. A set of complementary block units, suitable for use in panel construction, comprising:

a cylindrical block unit formed of glass material with front and rear surfaces respectively having front and rear peripheral edges spaced apart by a cylindrical side surface, said side surface suitable for receiving grout material; and an interstitial block unit with front and rear surfaces having peripheral edges each including four edge portions dimensioned and shaped for complementary fit with a portion of the peripheral edges of four cylindrical block units arranged in a pattern around said interstitial block unit with one of said four cylindrical block units contiguous to each of said four edge portions;

said interstitial block unit including, between said peripheral edges, four side surface portions positionable adjacent portions of side surfaces of said four cylindrical block units and suitable for receiving grout material.

20. The set of complementary block units as set forth in claim 19, wherein said front and rear peripheral edges of said cylindrical block unit are hexagonal and said four edge portions of said interstitial block unit are each linear and form a diamond shape.

21. The set of complementary block units as set forth in claim 19, wherein said front and rear peripheral edges of said cylindrical block unit are circular and said four edge portions of said interstitial block unit each comprise a portion of a circle.

22. The set of complementary block units as set forth in claim 19, wherein said front and rear peripheral edges of said cylindrical block unit are elliptical and said four edge portions of said interstitial block unit each comprise a portion of an ellipse.

23. The set of complementary block units as set forth in claim 19, wherein the said side surface of the cylindrical block unit includes one of a groove and a ridge and said four side surface portions of the interstitial block unit include one of a ridge and a groove dimensioned for complementary fit with said side surface of the cylindrical block unit.

* * * * *